US006220823B1

(12) United States Patent
Newcomer

(10) Patent No.: US 6,220,823 B1
(45) Date of Patent: Apr. 24, 2001

(54) AIR-OPERATED PUMP WITH SIMPLIFIED INLET STRUCTURE USEFUL IN FLOATING-LAYER SEPARATION APPLICATIONS

(76) Inventor: Kevin Newcomer, 13734 Shady La., Monroe, MI (US) 48161

( * ) Notice: Subject to any disclaimer, the term of this patent is extended or adjusted under 35 U.S.C. 154(b) by 0 days.

(21) Appl. No.: 09/468,233

(22) Filed: Dec. 21, 1999

Related U.S. Application Data

(60) Provisional application No. 60/113,292, filed on Dec. 22, 1998.

(51) Int. Cl.[7] ..... F04F 1/06; F04F 3/00

(52) U.S. Cl. ..... 417/118; 166/372; 210/104

(58) Field of Search ..... 417/2, 54, 90, 417/478, 423.3, 118; 166/372, 107, 54, 266; 210/104, 808, 109

(56) References Cited

U.S. PATENT DOCUMENTS

| | | | | |
|---|---|---|---|---|
| 3,617,152 | * | 11/1971 | Cummings | 417/54 |
| 3,669,275 | | 6/1972 | Downs | 210/242 |
| 3,963,377 | * | 6/1976 | Elliot et al. | 417/90 |
| 4,243,529 | | 1/1981 | Strauss | 210/109 |
| 4,273,650 | | 6/1981 | Solomon | 210/104 |
| 4,497,370 | * | 2/1985 | Breslin | 166/372 |
| 4,580,952 | | 4/1986 | Eberle | 417/383 |
| 4,663,037 | | 5/1987 | Breslin | 210/170 |
| 4,761,225 | * | 8/1988 | Breslin | 210/104 |
| 4,826,406 | | 5/1989 | Wells | 417/120 |
| 4,872,994 | | 10/1989 | Jakob | 210/691 |
| 4,886,432 | * | 12/1989 | Kimberlin | 417/478 |
| 4,966,534 | * | 10/1990 | Hasslen, III | 417/423.3 |
| 4,998,585 | | 3/1991 | Newcomer et al. | 166/105 |
| 5,058,669 | * | 10/1991 | Wells | 166/107 |
| 5,128,052 | * | 7/1992 | Bullock | 210/808 |
| 5,147,184 | | 9/1992 | Newcomer et al. | 417/394 |
| 5,183,391 | * | 2/1993 | Fiedler | 417/418 |
| 5,207,897 | * | 5/1993 | Baied et al. | 210/109 |
| 5,261,791 | * | 11/1993 | Gognen | 417/2 |
| 5,301,749 | * | 4/1994 | Fischer et al. | 166/54 |
| 5,484,023 | | 1/1996 | Shippee | 166/369 |
| 6,123,149 | * | 9/2000 | McKinze et al. | 166/266 |

* cited by examiner

*Primary Examiner*—Teresa Walberg
*Assistant Examiner*—L. Fastovsky
(74) *Attorney, Agent, or Firm*—Gifford, Krass, Groh, Sprinkle, Anderson & Citkowski, PC

(57) ABSTRACT

An air-operated, submersible pump features a simplified inlet design applicable to water pumping or fluid separation, including the recovery of viscous hydrocarbon products. The inlet area fluidly penetrates through a portion of the wall of the pump, and a flexible seal, disposed within the pump body, is supported in overlying registration therewith. A pressure-operated valve in fluid communication with the discharge port facilitates a refill mode of operation, wherein fluid surrounding the pump flows into the pump body through the inlet area, and a discharge mode of operation wherein the air inlet is pressurized, causing the seal to seat against and seal off the inlet area, and fluid which flowed into the pump body to be discharged through the discharge port. In the preferred embodiment, the inlet area comprises a plurality of apertures formed through the wall of the pump body arranged as one or more linear arrays lengthwise along the pump. When deployed to separate and recover a layer of fluid floating on water, a pump according to the invention pump further includes a water outlet and a water-outlet seal. During the refill mode of operation, water including the floating layer of fluid flows into the pump body through the inlet area, and in the discharge mode of operation, the pressurization further causes water which flowed into the pump body to be discharged through the water outlet until the outlet is sealed, after which the fluid which flowed into the pump body is discharged through the discharge port.

17 Claims, 3 Drawing Sheets

A-A

B-B

AIR-OPERATED PUMP WITH SIMPLIFIED INLET STRUCTURE USEFUL IN FLOATING-LAYER SEPARATION APPLICATIONS

REFERENCE TO RELATED APPLICATION

This application claims priority of U.S. provisional patent application Ser. No. 60/113,292, filed Dec. 22, 1998, the entire contents of which are incorporated herein by reference.

FIELD OF THE INVENTION

This invention relates to fluid pumping apparatus and, more particularly, to a submersible pump that may be used to separate and recover an underground layer of floating fluid, including hydrocarbons.

BACKGROUND OF THE INVENTION

It is often desirable, and sometimes required, to decontaminate groundwater by pumping contaminants from a well. This is possible if the contaminant is a separate or floating layer on or within the groundwater. If the contaminant is a hydrocarbon, an added benefit is that the fluid may be recycled for reuse. Pumps used to remove a floating liquid layer to an elevated location are disclosed in U.S. Pat. Nos. 5,147,184; 3,669,275; 4,243,529; 4,273,650; 4,663,037; 4,872,994; and 4,998,585.

A problem with existing designs is that they often require numerous component parts, including moving parts, and therefore tend to be complex. Such products often use stationary inlets in conjunction with hydrophobic screens, floating inlets attached to coils, or more complex inlet structures used in conjunction with sensors and pneumatic cylinders. Stationary inlets may be mispositioned out of the product when the water level drops, or they can be completely submerged under the water if the level raises to an unacceptably high degree. Hydrophobic screens can be easily fouled and plugged, and floating inlets can hang up for various reasons. Coils may also be plugged by discuss hydrocarbons, such as spent motor oil and other thicker fluids.

The need remains, therefore, for a submersible pump that may be used for simple pumping operations, including fluid separation. Ideally, such a pump would be able to handle a large water table fluctuation range, as well as viscous hydrocarbon products.

SUMMARY OF THE INVENTION

This invention resides in an air-operated, submersible pump having a simplified inlet design, resulting in an economical and reliable apparatus that many be used for water pumping of fluid separation, including the recovery of viscous hydrocarbon products.

The pump includes a pump body having a length, a wall, an air inlet, and a discharge port. The inlet area fluidly penetrates through a portion of the wall, and a flexible seal, disposed within the pump body, is supported in overlying registration with the fluid inlet. A pressure-operated valve in fluid communication with the discharge port facilitates a refill mode of operation, wherein fluid surrounding the pump flows into the pump body through the inlet area, and a discharge mode of operation wherein the air inlet is pressurized, causing the seal to seat against and seal off the inlet area, and fluid which flowed into the pump body to be discharged through the discharge port.

In the preferred embodiment, the inlet area comprises a plurality of apertures formed through the wall of the pump body arranged as one or more linear arrays lengthwise along the pump. The apertures may include a raised rim where they protrude into the pump body thereby helping the seal to seat thereagainst. Alternatively, the inlet area may incorporate slots, a mesh or screen panel, or a porous member, including a hydrophobic screen.

When deployed to separate and recover a layer of fluid floating on water, a pump according to the invention pump further includes a water outlet and a water-outlet seal. During the refill mode of operation, water including the floating layer of fluid flows into the pump body through the inlet area, and in the discharge mode of operation, the pressurization further causes water which flowed into the pump body to be discharged through the water outlet until the outlet is sealed, after which the fluid which flowed into the pump body is discharged through the discharge port.

According to one embodiment, the water-outlet seal further comprises a check ball seat, and a density-less-than-water check ball which engages with the seat in the presence of fluid from the floating layer. In another configuration, the water-outlet seal further comprises a valve seat, and a water float having a valve stem which engages with the valve seat when the level of water within the pump body falls to a predetermined level.

DETAILED DESCRIPTION OF THE INVENTION

Figure 1A:
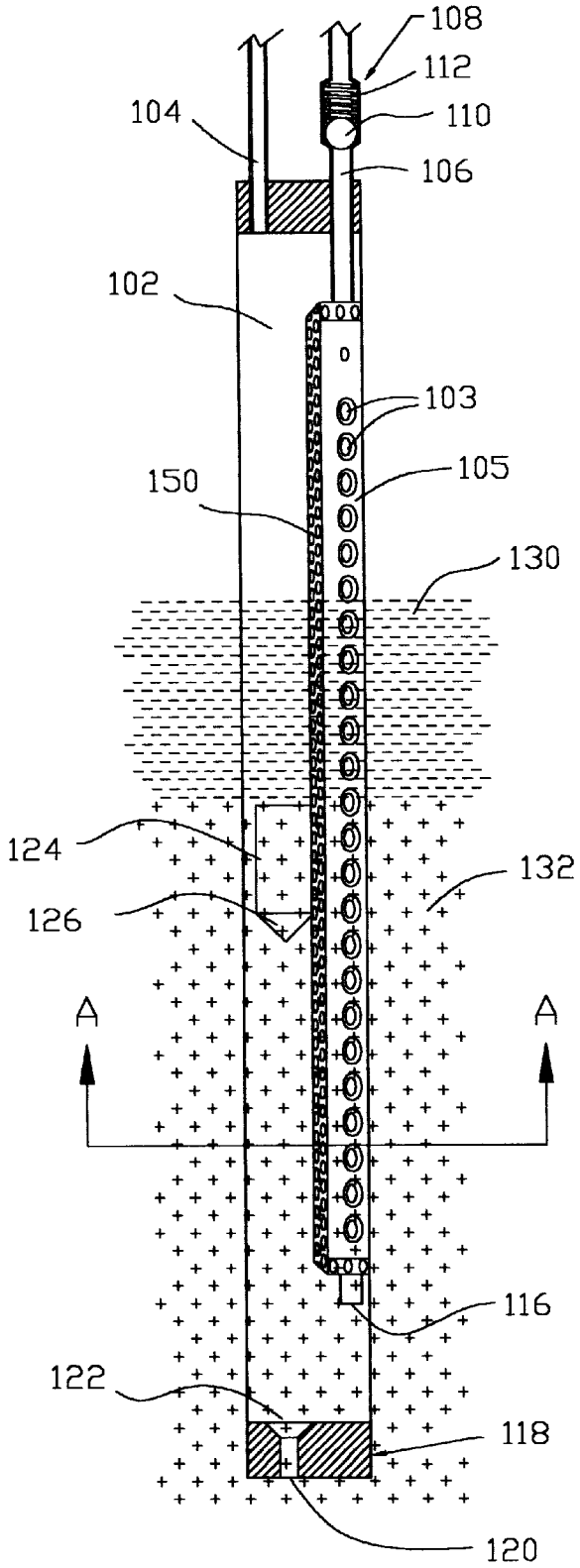
FIG. 1A is a simplified drawing, in partial cross-section, of a submersible pump according to the invention utilizing a water float within the body of the pump and a discharge check assembly at the proximal end of the pump body.
Figure 1B:
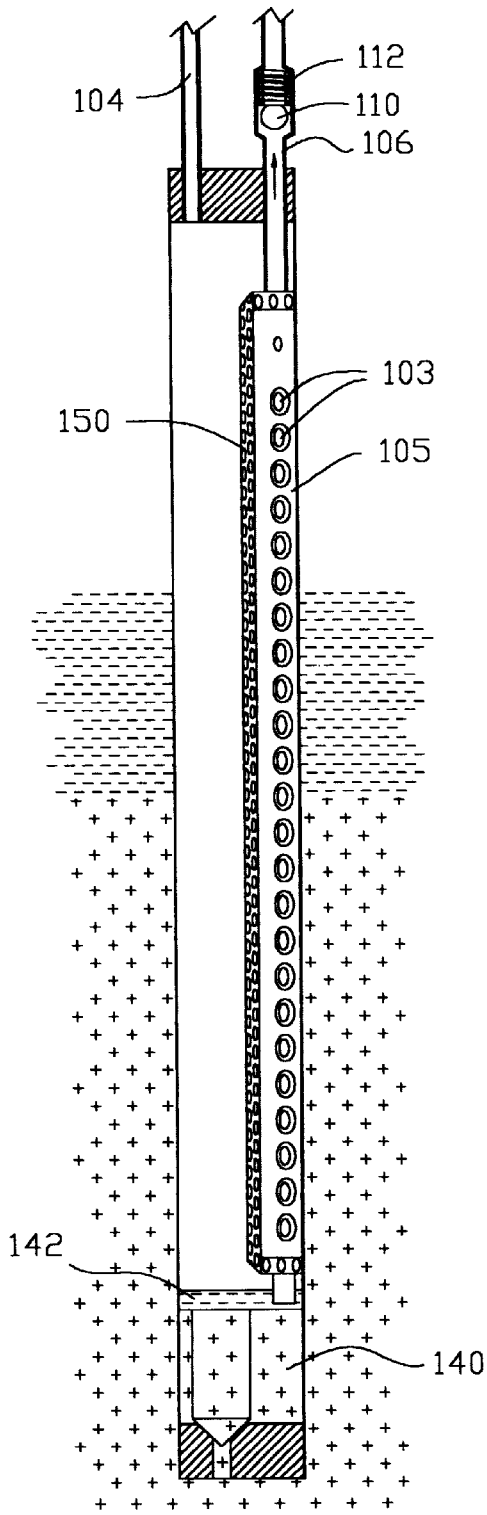
FIG. 1B is a drawing of the pump of FIG. 1A, having completed a discharge cycle.
Figure 1C:
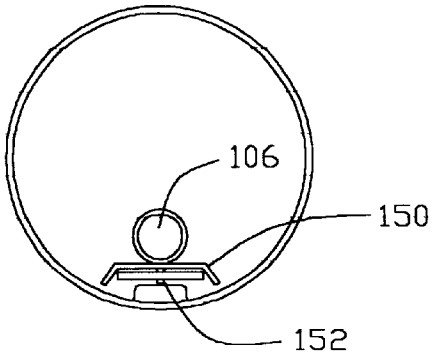
FIG. 1C is a section of the pump of FIG. 1A taken along line A—A.
Figure 1D:
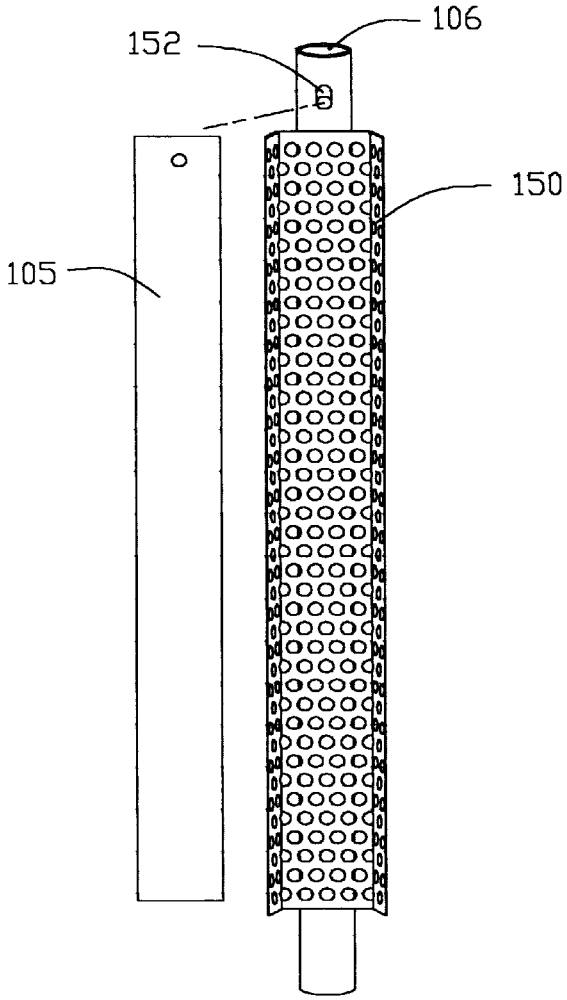
FIG. 1D is a perspective-view drawing of a screen used to hold a flap in place relative to a discharge tube.
Figure 2A:
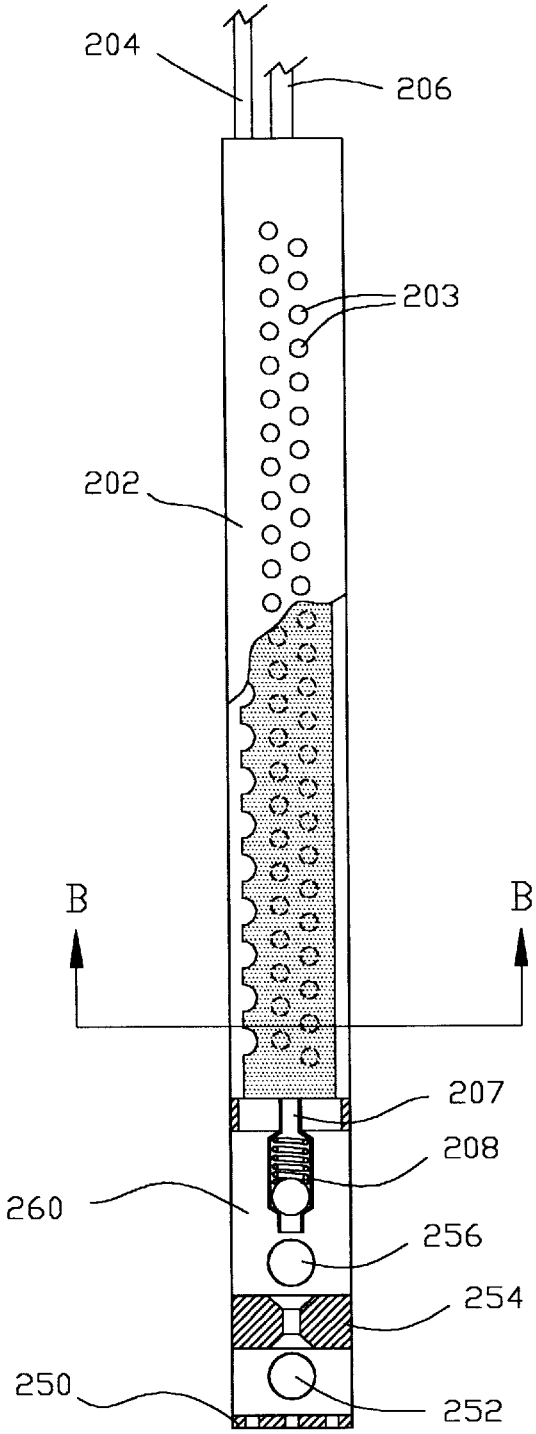
FIG. 2A is a drawing of alternative embodiment of the invention, wherein the pump body does not include a float, but wherein check assemblies are located toward the distal end of the pump body.
Figure 2B:
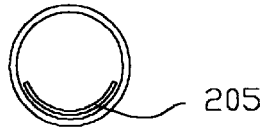
FIG. 2B is a section of the pump of FIG. 2A taken along line B—B.
Figure 2C:
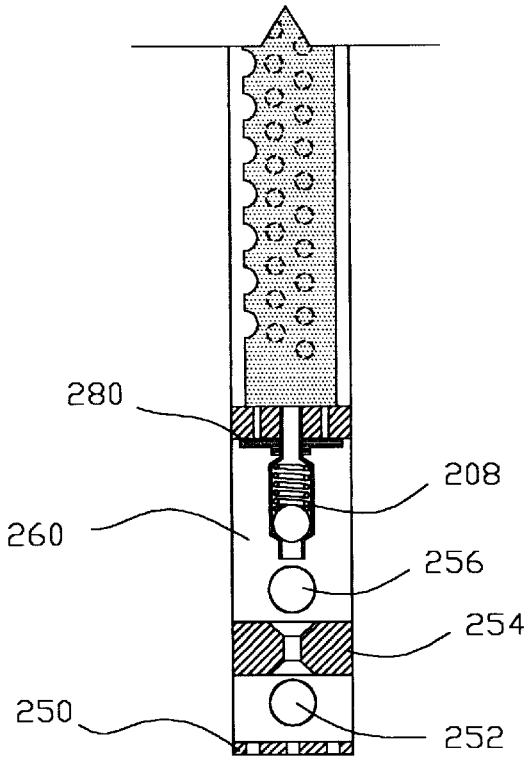
FIG. 2C is a drawing of a variant of the configuration of FIG. 2A, featuring the inclusion of a flapper or O-ring style check valve to allow layers of hydrocarbon or other fluids to accumulate.

Reference will now be made to the drawings, which will help to understand the preferred and alternative embodiments of the invention. FIGS. 1A–1C show an embodiment of the invention wherein a waterfloat is contained within the pump body, with discharge check assembly located at the proximal end of the pump, whereas FIGS. 2A through 2C show an alternative embodiment, wherein one or more check balls are disposed in chambers at the distal end of the pump body.

In FIG. 1A, the pump is at the end of a refill mode of operation, and at the onset of a discharge cycle. The apparatus includes a body 102, which is preferably an elongated cylinder constructed of a corrosion-resistant material such as stainless steel. Other materials and geometries may be used, however, with the length of the body being adjustable from a few inches to several feet, depending upon the application.

To address a wide range of needs, a preferred design is configured to fit within a two-inch diameter well or larger.

In the embodiment of FIG. 1, the proximal end of the pump body includes an air supply and exhaust line 104, which is interconnected to an above-ground pneumatic controller, which may be commercially available or of the types described in my copending U.S. patent application Ser. Nos. 09/370,729 and 09/370,771, the contents of both of which are incorporated herein by reference. Also located at the proximal end of the pump body is a discharge line 106 which, in this case, interconnects directly to a discharge check assembly 108 having a spring 112 operative to urge a check ball 110 against a lower seat until a predetermined within line 106 is reached.

Along the body 102 of the pump, there is disposed a series of apertures or perforations 103, which penetrate through the way of a body 102 and into the interior of the pump. In the preferred embodiment, at least one row of such apertures are disposed longitudinally along the body of the pump, though, additional rows having a varying spacing may alternatively be used. In addition, and in all configurations of the invention, as opposed to a plurality of apertures, the inlet area may be made with slots, mesh, screen, a porous member and/or a hydrophobic screen.

According to the invention, immediately behind the apertures 103 there is disposed an elastomeric seal, which presses against the perforations from the inside to seal them off during the discharge mode of operation described with reference to FIG. 1B. Materials such as neoprene, synthetic rubber, Teflon and other materials may be used to construct the elastomeric seal. The seal material 105 may conveniently adhered to the discharge tube within the pump body as shown, allowing the material 105 to be spaced apart at a convenient and functional distance from the inlets 103. As shown in cross-section A—A of FIG. 1C and FIG. 1D, a perforated screen 150 of stainless steel or other non-corrosive material may be used to contain the flap of material 105 so that it will not be dislocated. The screen is preferably tack-welded to the discharge tube 106, with the material 105 being held with a pin 152, clamp, or other suitable attachment mechanism.

FIG. 1B shows the pump in a refill mode, wherein fluid is entering one of the perforations 103 and into the pump body, with the piece of elastomeric material 105 flexing away from the apertures 103 to permit fluid to flow past the seal 105 and into the pump body. Although the perforations 103 may be made through the wall of the pump body without any raised areas, in the preferred embodiment, the perforations 103 include dimples facing inwardly of the body, such that when the flap of material 105 closes thereagainst, a tighter seal is realized.

Continuing the reference to FIG. 1A, at the distal end 118 of the pump, there is a water outlet passage 120 featuring a valve seat 122. A water float 124 having a corresponding seating member 126, is shown floating on top of a water layer 132. The bottom extent of the discharge line is shown at point 116. Pumps according to the invention may be used for different purposes, including the pumping of a singular fluid, such as water. Alternatively, the pumps of this invention may be used for fluid separation purposes, for example, to recover hydrocarbons found floating on a layer 130 above an aquifer 132. In such a case, the float 124 is composed of a material which will float on water, but which will sink in the layer of hydrocarbon 130, which may be gasoline, or other types of petroleum distillates and fuels.

As mentioned, FIG. 1A illustrates an embodiment of a pump just after a refill mode of operation, and at the commencement of a discharge cycle. In this example, the fluid layer 130 will be discharged. To begin this process, the surface controller supplies a surge of compressed air along line 104. The spring 112 has sufficient strength to hold the check ball 110 against the seat and discharge line 106, at least until pressure within the body of the pump proceeds to a predetermined level. This pushes the seal material 105 against the openings 103, sealing them off. The increasing pressurization causes the float valve 124 and 126 to move downwardly toward the distal end of the pump, forcing the water back out through the water outlet 120. This continues until the valve seats, as shown in FIG. 1B. A small volume of water 140 remains in the pump, but the body of the is now otherwise sealed from discharges other than discharge line 106.

Pressure continues to build within the body of the pump to a level beyond that just required to push the check ball 110 away from the seat. This causes the lighter-than-water fluid 142 to be forced up through the discharge line, past the check ball for above-ground recovery. The seal 105 is urged against the openings 103 until the pressurization delivered through line 104 ceases. At this point, line 104 returns to atmosphere, and becomes an exhaust line, allowing the seal 105 to move away from the inlets, allowing a new charge to enter into the pump body, thus commencing the next full cycle.

FIG. 2A is a drawing which shows an alternative embodiment of the invention, wherein check assemblies are located in chambers distally or below the central body of the pump 202. An air or gas inlet line is shown at 204, and the discharge line at 206. The discharge check assembly, however, is now positioned at 208, but nevertheless attaches to the distal end of the discharge line at 207. At the distal-most end of the pump body is a water outlet screen 250. Above that is a first density-less-than-water check ball 252, which engages with a lower seating depression in a water ejection port 254. Above port 254, is a second density-less-than-water ball check 256, contained in a separation/accumulation chamber 260. As shown in FIG. 2B, an elastomeric seal 205 is again used in this embodiment, which seats against the inlet area, in this case shown as two longitudinal rows of apertures 203.

FIG. 2A shows the pump following a refill mode of operation and prior to the onset of the discharge mode. In this state, the pump is in an exhaust mode, allowing water and/or hydrocarbon to flow in through the inlet area. Note that the check balls 252 and 256, having a density less than water, float freely, as shown. At the commencement of the discharge cycle, an above-ground controller supplies a surge of compressed air. This causes the elastomeric seal to be forced against the inlet holes, thereby closing them off, as described above with reference to FIGS. 1A–1C. The water and/or hydrocarbon layer is then trapped inside the pump body. The air pressure forces the water out of the injection port, with the check balls 252 and 256 floating freely and not impeding the discharge of water. As the water is expelled, the hydrocarbon layer drops into the separation area 260, causing the second density-less-water check ball to seat on top of the ejection port, thereby creating a seal.

Pressure continues to build inside the pump, causing the discharge check valve 208 to unseat at a predetermined pressure. This allows the hydrocarbon to be pushed up through the discharge line at interface 207, and through port 206. The controller then shifts to the refill mode, exhausting the compressed air in the pump. The head pressure from the fluid on the outside of the pump pushes the elastomeric seal away from the inlet area, the pump is refilled with hydrocarbons and/or water, and the cycle repeats.

FIG. 2C is a drawing which shows a variant on the design of FIGS. 2A and 2B, with the incorporation of a flapper or O-ring type of seal 280. This valve, which is located between the inlet area and the separation chamber, traps the hydrocarbon, allowing thin layers to accumulate in the separation chamber until an adequate amount of hydrocarbon has accumulated conducive to discharge. Note that the addition of seal 280 obviates the need for check ball 252, which keeps water from entering the bottom of the pump, thereby ensuring that the main pump chamber fills from the top where the hydrocarbons are located.

I claim:

1. An air-operated, submersible pump, comprising:

a pump body having a length, a wall, an air inlet, and a discharge port;

a fluid inlet area associated with at least a portion of the wall of the pump body;

a flexible seal disposed within the pump body, the seal being aligned in overlying registration with the fluid inlet area; and a pressure-operated valve in fluid communication with the discharge port, the pump having a refill mode of operation, wherein fluid surrounding the pump flows into the pump body through the inlet area, and a discharge mode of operation wherein the air inlet is pressurized, causing:

a) the seal to seat against and seal off the inlet area, and b) fluid which flowed into the pump body to be discharged through the discharge port.

2. The pump of claim 1, wherein the inlet area comprises a plurality of apertures formed through the wall of the pump body.

3. The pump of claim 2, wherein the apertures are arranged as one or more linear arrays along the length of the pump body.

4. The pump of claim 2, wherein the apertures include a raised rim where they protrude into the pump body thereby helping the seal to seat thereagainst.

5. The pump of claim 1, wherein the inlet area comprises one or more slots formed through the wall of the pump body.

6. The pump of claim 1, wherein the inlet area comprises a mesh, screen or porous member.

7. The pump of claim 6, wherein the inlet area comprises a hydrophobic screen.

8. The pump of claim 1, being adapted to separate and recover a layer of fluid floating on water, the pump further comprising:

a water outlet; and a water-outlet seal;

wherein, during the refill mode of operation, water including the floating layer of fluid flows into the pump body through the inlet area, and in the discharge mode of operation, the pressurization further causes water which flowed into the pump body to be discharged through the water outlet until the outlet is sealed, after which the fluid which flowed into the pump body is discharged through the discharge port.

9. The pump of claim 8, wherein the water-outlet seal further comprises:

a check ball seat; and a density-less-than-water check ball which engages with the seat in the presence of fluid from the floating layer.

10. The pump of claim 8, wherein the water-outlet seal further comprises:

a valve seat; and a water float having a valve stem which engages with the valve seat when the level of water within the pump body falls to a predetermined level.

11. An air-operated, submersible pump, comprising:

an elongated pump body having an inlet chamber with a wall, an air inlet, and a discharge port;

a plurality of apertures formed through the wall and into the inlet chamber, the apertures being spaced apart along the body of the pump;

an elongated flap of flexible material disposed within the inlet chamber in overlying registration with the apertures; and a pressure-operated valve in fluid communication with the discharge port, the pump having a refill mode of operation, wherein fluid surrounding the pump flows into the pump body through the apertures, and a discharge mode of operation wherein the air inlet is pressurized, causing:

a) the material to close off the apertures, and b) fluid which flowed into the pump body to be discharged through the discharge port.

12. The pump of claim 11, wherein the apertures are substantially round holes.

13. The pump of claim 11, wherein the apertures are elongated slots.

14. The pump of claim 11, wherein the apertures include a raised rim where they protrude into the pump body thereby helping the seal to seat thereagainst.

15. The pump of claim 11, being adapted to separate and recover a layer of fluid floating on water, the pump further comprising:

a water outlet; and a water-outlet seal;

wherein, during the refill mode of operation, water including the floating layer of fluid flows into the pump body through the apertures, and in the discharge mode of operation, the pressurization further causes water which flowed into the pump body to be discharged through the water outlet until the outlet is sealed, after which the fluid which flowed into the pump body is discharged through the discharge port.

16. The pump of claim 8, wherein the water-outlet seal further comprises:

a check ball seat; and a density-less-than-water check ball which engages with the seat in the presence of fluid from the floating layer.

17. The pump of claim 8, wherein the water-outlet seal further comprises:

a valve seat; and a water float having a valve stem which engages with the valve seat when the level of water within the pump body falls to a predetermined level.

* * * * *